US006164216A

United States Patent [19]

Collier

[11] Patent Number: 6,164,216

[45] Date of Patent: Dec. 26, 2000

[54] ROTATABLE SHELF

[76] Inventor: David E. Collier, 108 Greenpoint Cir., Chicopee, Mass. 01020-3910

[21] Appl. No.: 09/351,233

[22] Filed: Jul. 12, 1999

[51] Int. Cl.[7] ..... A47B 11/00

[52] U.S. Cl. ..... 108/104; 248/235; 211/131.1

[58] Field of Search ..... 248/235, 241, 248/349.1, 131, 314, 415; 211/95, 88.01, 1.52, 131.1, 144; 312/408; 108/103, 104, 139, 20, 22

[56] References Cited

U.S. PATENT DOCUMENTS

| | | | |
|---|---|---|---|
| 1,217,730 | 2/1917 | Esrey | 108/104 |
| 1,687,149 | 10/1928 | Shauer et al. | 108/104 |
| 1,859,352 | 5/1932 | Albee | 248/131 |
| 2,109,999 | 3/1938 | Johnson | 108/104 |
| 2,380,005 | 7/1945 | Wilson | 211/131.1 |
| 2,403,164 | 7/1946 | Ahrens et al. | 211/131.1 |
| 2,833,609 | 5/1958 | Lawless | 108/104 |
| 2,836,305 | 5/1958 | Davey et al. | 312/408 |
| 3,000,514 | 9/1961 | Hallmark | 108/104 |
| 3,073,431 | 1/1963 | Davis et al. | 211/131.1 |
| 4,330,696 | 5/1982 | Pomeroy et al. | 108/139 |
| 4,450,774 | 5/1984 | Weaver | 108/104 |
| 4,591,123 | 5/1986 | Bradshaw et al. | 248/349.1 |
| 4,948,086 | 8/1990 | Buol et al. | 248/676 |
| 5,056,332 | 10/1991 | Tajima et al. | 62/252 |
| 5,577,823 | 11/1996 | Maglinger | 312/408 |
| 5,810,462 | 9/1998 | Lee | 312/408 |

*Primary Examiner*—Anita M. King
*Assistant Examiner*—Jon A Szumny

[57] ABSTRACT

A rectangular shelf has a large circular hole therein. A round shelf insert being of about the same thickness as the shelf. The insert has a flange thereon and the insert is placed within the hole with the flange resting on the rectangular shelf. The bottom of the round shelf has a plurality of finger catches mounted equally spaced around the circumference. A large fixed catch is mounted on the rectangular shelf approximate to the hole. In order to turn the round shelf, several fingers are placed on one of the finger catches and the thumb is placed on the fixed catch on the shelf. By squeezing the hand together, the round shelf will rotate within the hole therein or one could reach under the shelf and grab two of the finger catches on opposite sides and then turn the shelf. This will allow the round shelf to rotate and bring to the front items of interest. Small items can still be located on the nonmoving part of the shelf.

1 Claim, 4 Drawing Sheets

ROTATABLE SHELF

CROSS-REFERENCES TO RELATED PATENT APPLICATIONS

NONE

BACKGROUND OF THE INVENTION

The present invention relates to shelves, and, in particular, relates to shelves that can be moved to reach items thereon.

In a conventional refrigerator, not shown, the shelving consists of a plurality of rectangular sheets of glass mounted in frames that can be mounted in various vertical positions within the main storage area. Food items are then placed on the shelf. Old items being pushed to the back. In order to reach the older items if you can see them, items are either pushed around or even removed to reach the ones in the back. Over time, items become lost and hidden by items in the front.

DESCRIPTION OF RELATED ART

Potential solutions to this problem are shown in U.S. Pat. No. 5,056,332 where the refrigerator has an interior and outer circular shape so that substantially round shelves are mounted therein. These shelves have hinges on one side so that one can turn the shelf out of the inside storage area so that items thereon can be easily reached. This unique design restricts the total appearance and is not adaptable to existing appliances.

Another example is U.S. Pat. No. 5,577,823 where a rotatable deep bowl pan is rotatably mounted under a cover. The pan can be pulled to the front, uncovered, and then turned to reach items therein. This design restricts the area under the shelf because of the deep bowl pan with an attendant loss of storage space on the shelf thereunder.

Thus, there exists a need for a rotatable shelf which can be used in conventional refrigerators or used in other locations.

BRIEF SUMMARY OF THE INVENTION

A rectangular shelf has a large circular hole therein. A round shelf insert having a flanger thereon is placed within the hole with the flange resting on the rectangular shelf. The bottom of the round shelf insert has a plurality of finger catches mounted equally spaced around the circumference. A large fixed catch is mounted on the rectangular shelf approximate to the hole. In order to turn the round shelf, several fingers are placed on one of the finger catches and the thumb is placed on the fixed catch on the shelf. By squeezing the hand together, the round shelf will rotate within the hole therein or one could reach under the shelf and grab two of the finger catches on opposite sides and then turn the shelf. This will allow the round shelf to rotate and bring to the front items of interest. Small items can still be located on the nonmoving part of the shelf.

Therefore, one object of the present invention is to provide a rotatable shelf for use in refrigerators and cabinets, for example, that minimize the space used.

Another object of the present invention is to provide a rotatable shelf having a vertical thickness approximate that of a conventional shelf to maximize storage area thereunder.

Another object of the present invention is to provide a rotatable shelf that is hand operated.

Another object of the present invention is to provide a rotatable shelf that is operated electrically.

These and many other objects and advantages of the present invention will be ready apparent to one skilled in the pertinent art from the following detailed description of a preferred embodiment of the invention and the related drawings.

DETAILED DESCRIPTION OF THE INVENTION

Figure 1:
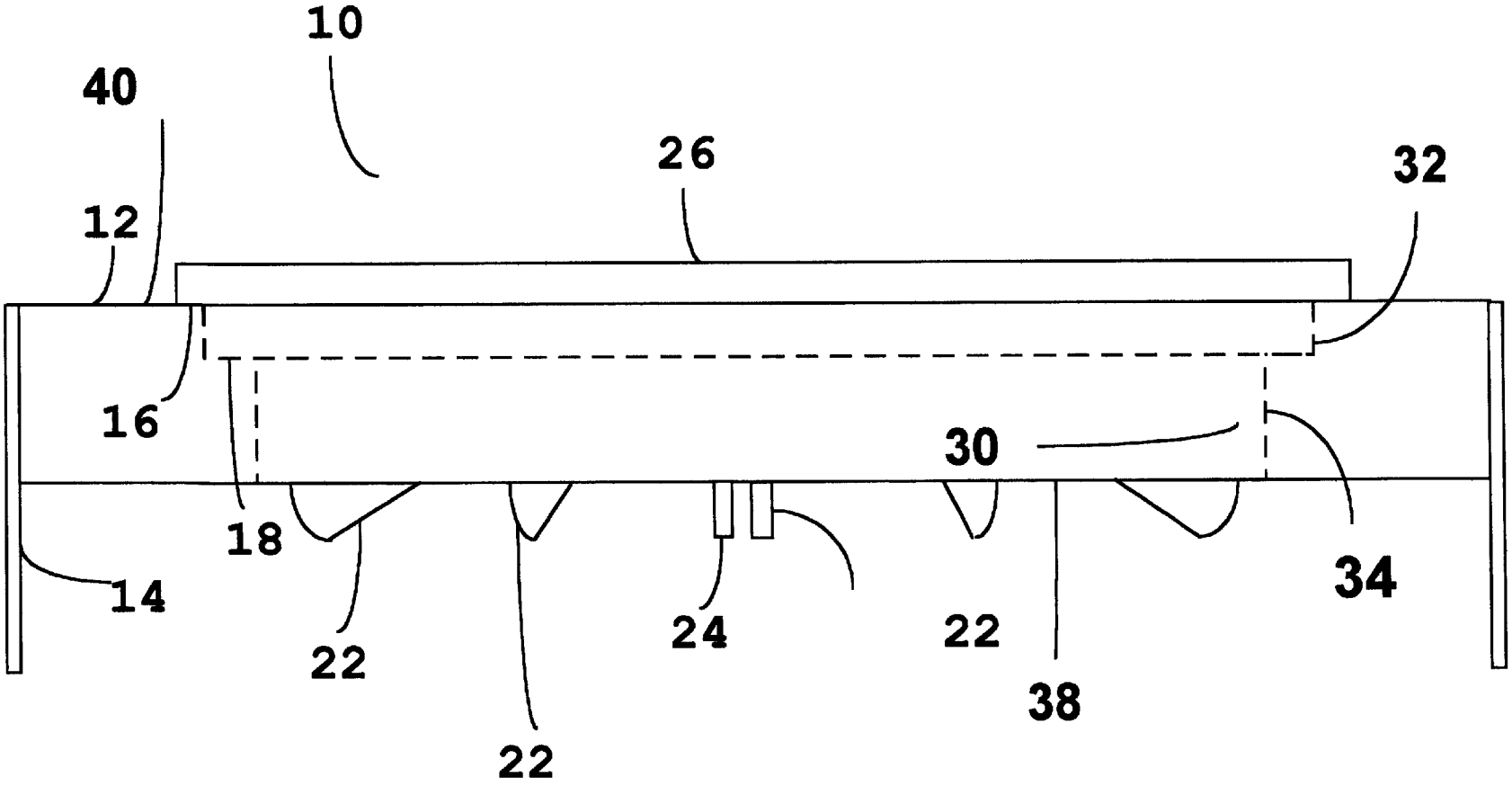
FIG. 1 illustrates by front view a rotatable shelf for use in a refrigerator, for example.

Referring to FIG. 1, an improved shelf 10 is shown. This improved shelf 10 is intended for use in a conventional refrigerator. Support brackets 14, being conventional, one on each side of the shelf 10, are used to mount the improved shelf 10 to the rear of the refrigerator. Other methods of mounting are clearly possible. The brackets 14 are mounted onto a shelf 12 which is normally rectangular in shape.

Figure 3:
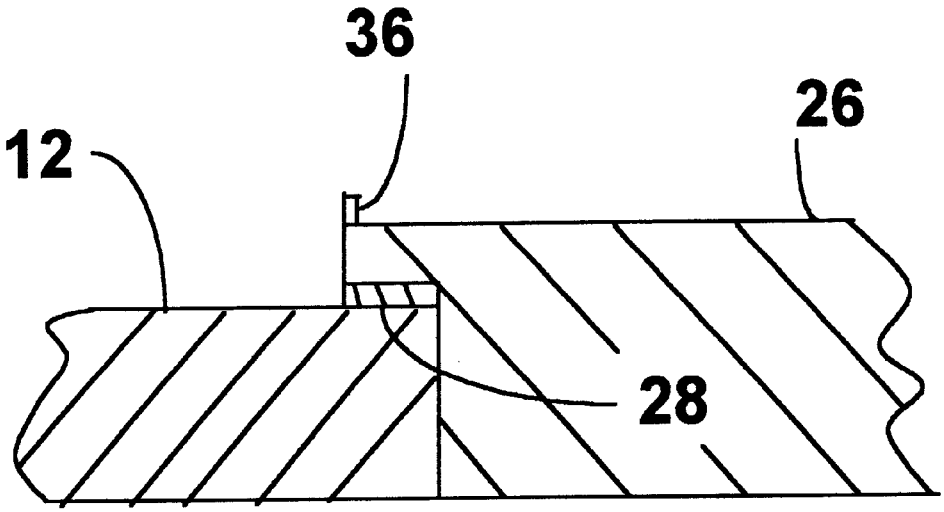
FIG. 3 is a partial cross section of the shelf having a single wall.

A large circular hole 30 is positioned in a shelf 12. The circular hole 30 may have one wall thereabout as seen in FIG. 3, or have an upper wall 32 and a lower wall 34 thereabout with the upper wall 32 being offset from the lower wall 34 with a step 18 therebetween. The shelf 12 and rotatable insert 26 may be made of durable plastic or even glass although durable plastic would be preferred since this would allow forming the catches and walls easily during manufacture as an integral part of the shelf and insert.

The rotatable insert 26 has corresponding walls and steps to fit within the hole 30. If there is a step 18 within hole 30, the need for an overhanging lip 16 to support the insert 26 is reduced although the lip 16 may serve another purpose of preventing dirt, liquid and other material from falling into the space formed between hole 30 and insert 26. This relationship is more clearly shown in FIG. 2. Also as seen in FIG. 3, a vertical lip 36 may be placed about the upper surface of the insert 26 to prevent items from falling off.

Figure 2:
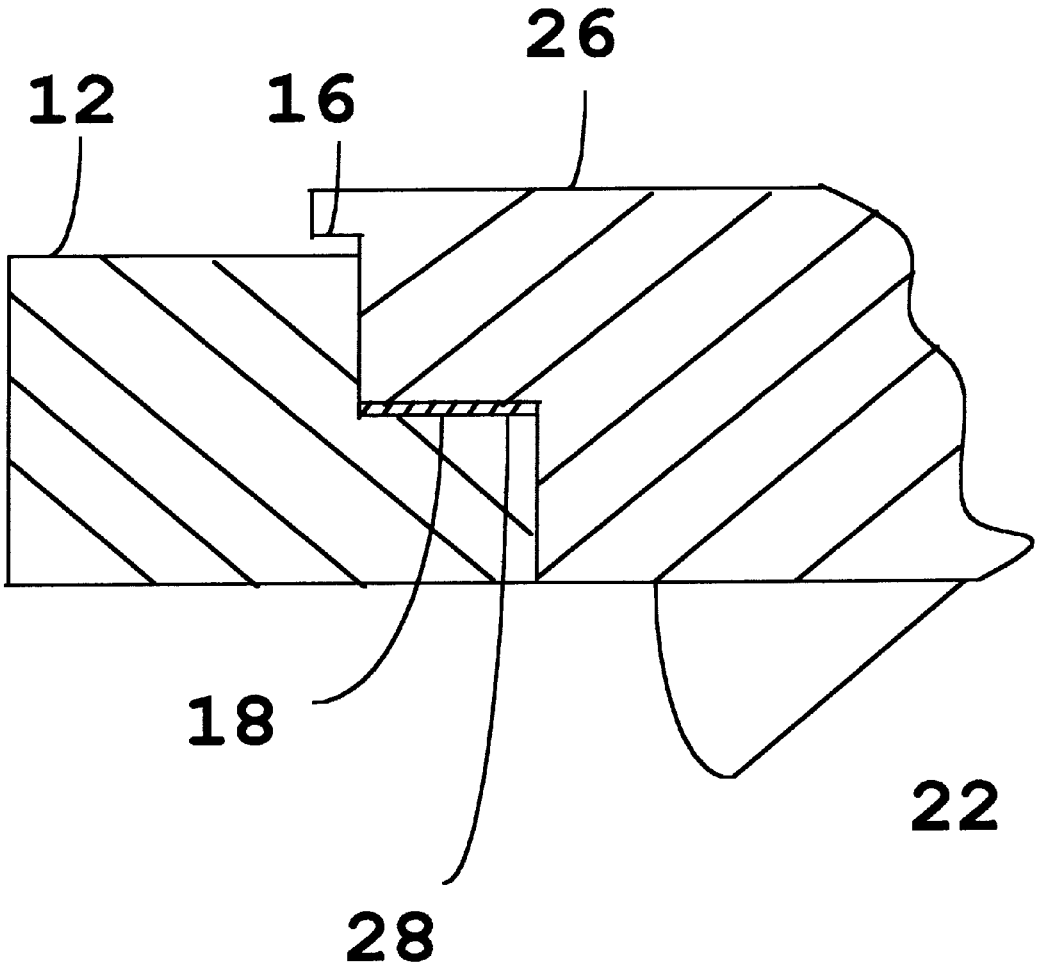
FIG. 2 is a partial cross section of the shelf of FIG. 1.

As seen in FIG. 2, a gasket 28 may rest upon the step 18. This gasket may be made of Teflon or similar materials which will allow the insert 26 to be easily rotated. If there is no step 18 as shown in FIG. 3, the gasket 28 may be placed under the lip 16 which would then support the weight of the insert 26 on the top surface 40 of the shelf 12.

As seen in FIG. 1, a plurality of finger catches 22 are located about the bottom 38 of the insert 26 near the outer circumference. A fixed finger catch 24 is located on the shelf 12 and near finger catches 22. By placing several fingers on the catch 22 and a thumb on the fixed catch 24, the insert 26 may be rotated by squeezing of the fingers and thumb together. In an alternative method of rotation, both hands could be used to turn the insert 26 by grasping two opposing catches 22.

Figure 4A:
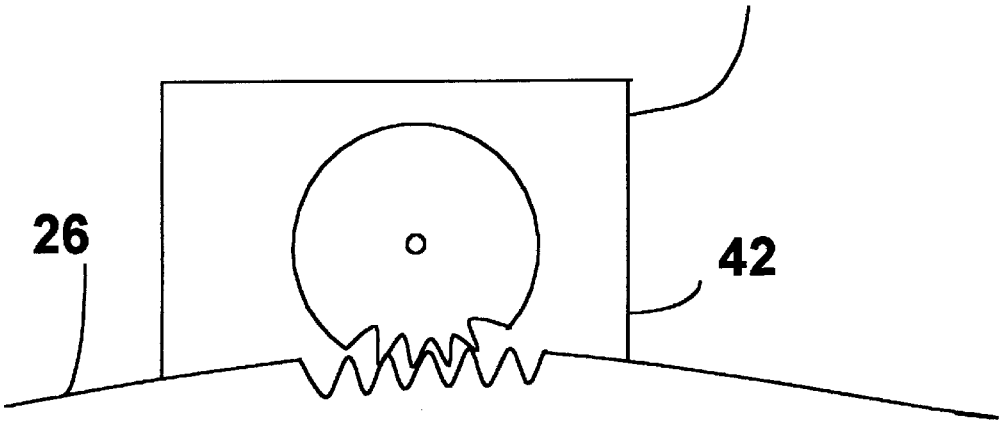
FIGS. 4A and 4B illustrate other means of rotating the insert of FIG. 1.
Figure 4B:
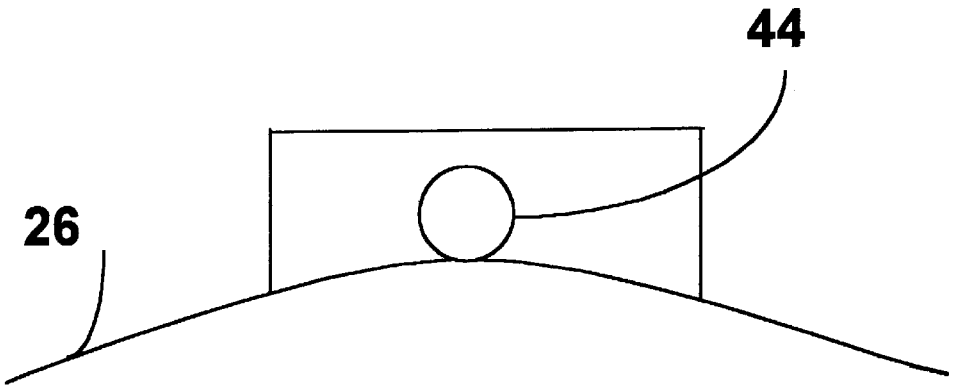

Although hand operation may be the most desired method since the rotatable shelf could be used in many different appliances, the insert 26 could easily be rotated by an electric motor 42 being geared to insert 26 as shown in FIG. 4A or have a pressure roller 44. An on/off switch could be mounted on this shelf 12.

Clearly many modifications and variations of the present invention are possible in light of the above teachings and it is therefore understood, that within the inventive scope of the inventive concept, that the invention may be practiced otherwise than specifically claimed.

What is claimed is:

1. A rotatable shelf, said rotatable shelf comprising:

a rectangular shelf, said shelf having a circular hole therein;

a rotatable insert, said rotatable insert being positioned within the circular hole, said rotatable insert having a thickness substantially like that of said rectangular shelf; and means for rotating said rotatable insert, said means for rotating comprising:

at least one fixed finger catch mounted on the bottom of said rectangular shelf and in close proximity to the circular hole; and finger catches, said finger catches being mounted on the bottom of the insert near the circumference and uniformly spaced about said rotatable insert, whereby a user of said rotatable shelf places at least one hand in close proximity to said at least one fixed finger catch and proximally to one of said finger catches mounted on said rotatable insert and forces said one of said finger catches in a direction of said at least one fixed finger catch to cause said rotatable insert to turn, said user repeating until a desired position is obtained.

* * * * *